United States Patent [19]

Blank et al.

[11] Patent Number: 4,979,300

[45] Date of Patent: Dec. 25, 1990

[54] CUTTING AND SCRAPING TOOL USING RAZOR BLADES

[76] Inventors: William J. Blank, 18 Collins Ave., Merrimack, N.H. 03051; Michael D. Hurley, 35 High St., Belfast, Me. 04915; Claude R. Bessette, 2 Mile Rd., Amherst, N.H. 03031; William R. Eldridge, 14 Pearl St., Belfast, Me. 04915

[21] Appl. No.: 437,169

[22] Filed: Nov. 16, 1989

[51] Int. Cl.[5] ..... B26B 3/00; B26B 9/00

[52] U.S. Cl. ..... 30/169; 30/346.5

[58] Field of Search ..... 30/2, 169, 136, 136.5, 30/346, 346.5, 329

[56] References Cited

U.S. PATENT DOCUMENTS

| | | | |
|---|---|---|---|
| 834,022 | 10/1906 | Phillips | 30/169 |
| 1,991,097 | 2/1935 | Johnston | 30/346.5 |
| 2,233,184 | 2/1941 | Rufleth | 30/169 |
| 2,821,017 | 1/1958 | Liesunaitis | 30/169 |
| 3,173,206 | 3/1965 | Chambers | 30/169 |
| 3,430,339 | 3/1969 | Hobson | 30/2 |
| 4,189,829 | 2/1980 | Iten et al. | 30/169 |
| 4,238,883 | 12/1980 | Jacobson et al. | 30/162 |
| 4,381,604 | 5/1983 | Horst | 30/169 |
| 4,612,707 | 9/1986 | Shea | 30/162 |
| 4,803,751 | 2/1989 | Cousins | 30/169 |

*Primary Examiner*—Douglas D. Watts
*Assistant Examiner*—Paul M. Heyrana, Sr.

[57] ABSTRACT

A cutting and scraping tool has a molded, one piece body having a first portion to be held by one hand of the user and an integral blade receiving and holding portion. The blade receiving portion has a first wall which is thinner than the first portion and establishes a shoulder at the junction of the two portions. The first wall has an extension at one end which includes a section of approximately the size and shape of the first wall and a flexible connecting web enabling the section to become a second wall when folded against the first wall then to define a blade holding slit the bottom of which is the shoulder and which is dimensioned to accommodate a blade with one edge exposed. One end of the slit is closed by the web and the other ends of the walls are releasably connected to permit blade placement and removal. A blade within the slit is held against movement by bosses on one wall passing through openings in the blade and into sockets in the other wall.

5 Claims, 1 Drawing Sheet

CUTTING AND SCRAPING TOOL USING RAZOR BLADES

BACKGROUND OF THE INVENTION

Razor blades, both single and double edged, are commonly used for various purposes in most homes. The risks attendant their uses of cutting the users has long been recognized and have lead to the development of a variety of hand held tools to which razor blades are detachably attached.

For household uses, such tools having bodies of suitable plastics have been well received but as far as we are aware, no such tool provides a construction that enables the blades to be handled safely with maximum ease and convenience.

THE PRESENT INVENTION

The general objective of the present invention is to provide hand held scraping and cutting tools using razor blades which are not only safer to use but also are more economical to produce. The blades may be of either single or double edge types.

In accordance with the invention, this objective is attained with a molded body having a first portion shaped and dimensioned to be held by one hand of the user and a second portion in which a blade is detachably held.

The second portion has first and second transverse walls of approximately the same size and shape. The first wall is of less thickness than the adjacent end of the first or hand held portion and defines therewith a transverse shoulder. The two walls are releasably connected to establish a slit the bottom of which is the transverse shoulder and which is dimensioned to hold a blade with either edge exposed. Razor blades have one or more openings to receive a corresponding boss or bosses of the blade holding head of a razor and one of the slit forming walls has a corresponding boss or bosses. In practice, the other wall has a boss receiving socket or sockets. The means releasably connecting the walls is operable to release the walls one from the other to enable a blade to be positioned on one of them to be held in place by the boss or bosses when the slit is reestablished by again interconnecting the walls.

An important objective of the invention is to insure that manufacturing costs are minimized. This objective is attained by molding the body with the second wall an integral part. In practice, the second wall is connected to one end of the first wall as an extension thereof by a flexible web. The free end of the second wall and the corresponding end of the first wall are releasably interconnected by providing one of them, preferably the second wall, with a latch shaped and dimensioned to pass through and engage the margin of an opening in the other wall.

Another important objective of the invention is to prevent the latch from being accidentally released when the tool is being used with the projecting end of the latch disposed towards the surface being scraped. This objective is attained by providing the shoulder with a projection or projections overlying the first wall and so spaced therefrom as to define therewith a channel holding the proximate edge of the blade from exerting releasing pressure on the second wall which, in practice, is recessed to so accommodate the projection or projections that they and the second wall may lie in the same plane.

With this construction the body of the tool may be and preferably is an injection molded plastic body. Safety in the use of the tool is maximized and low production costs assured since there are no separate parts.

In use, with the second wall of the blade holding slit released from the first wall and unfolded, a blade is simply laid in position on the first wall with respect to the holding means and the second wall then folded against and locked to the first wall.

Other novel features and advantages of the present invention will be apparent from the accompanying drawings and specification and the appended claims.

BRIEF DESCRIPTION OF THE DRAWINGS

The accompanying drawings illustrate a preferred embodiment of the invention of which.

THE PREFERRED EMBODIMENT OF THE INVENTION

Figure 7:
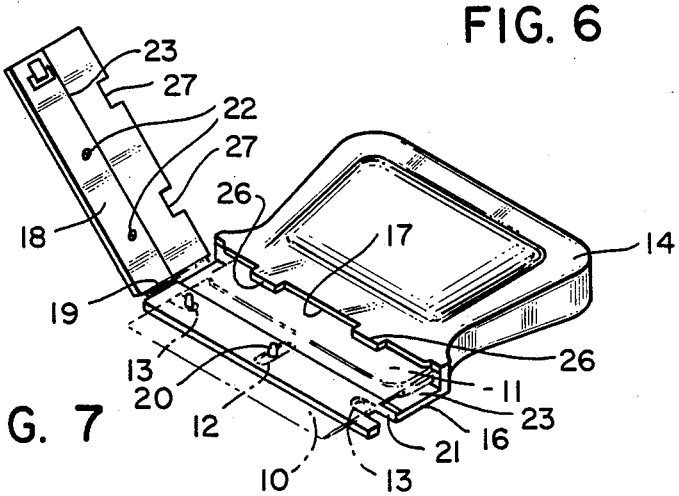
FIG. 7 is a view, generally similar to FIG. 2, with a single edge blade, shown in phantom, placed in position on the second wall.

The embodiment of the cutting and scraping tool illustrated by the drawings is for use with razor blades of the single edge type and one such is shown in phantom in FIG. 7 and is generally indicated at 10. Such blades are readily available and are well adapted for various uses. The edge of such a blade opposite the cutting edge is confined in a narrow channel 11 and has openings disposed for the reception of bosses with which razors for use with such blades are provided. One such opening is a central slot 12, normal to the edges of the blade, and end recesses 13 located along the longitudinal center line of the blade and bisects the slot 12.

The tool is injection molded and includes a first portion 14 shaped and dimensioned to be held by one hand of the user and has an integral blade holding end portion, generally indicated at 15. The end portion 15 has a first wall 16 of less thickness than the adjacent end of the hand held portion 14 and establishes therewith a transverse shoulder 17 at the junction of the two portions.

Figure 1:
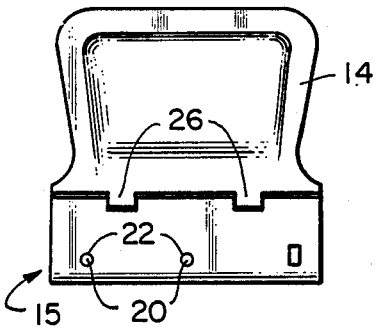
FIG. 1 is a plan view of one side of the cutting and scraping tool.
Figure 2:
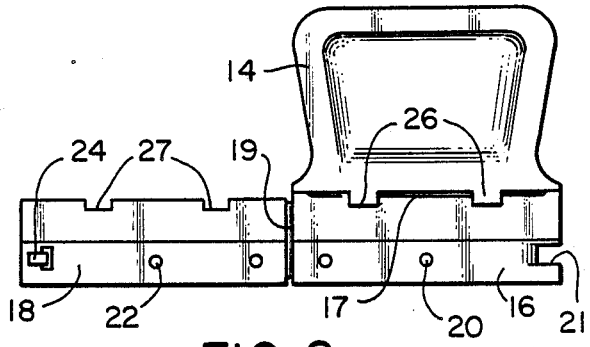
FIG. 2 is a like view but with the second wall unfolded to expose the first wall.
Figure 3:
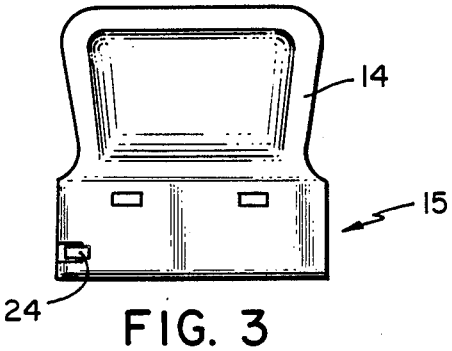
FIG. 3 is a plan view of the other side of the tool.
Figure 4:
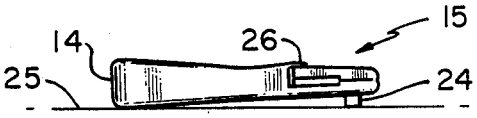
FIG. 4 is a view of the tool as seen from one side.
Figure 5:
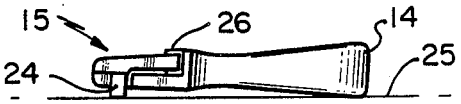
FIG. 5 is a like view of the opposite side of the tool.
Figure 6:
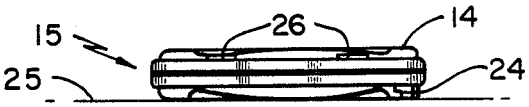
FIG. 6 is a view of the tool as seen from the open end of the blade receiving slit.

The first wall 16, see FIGS. 2 and 7, has at one end an integral extension including a section constituting a second wall 18 and an intermediate, flexible connecting web 19 enabling the second wall 18 to be folded against the first wall 16. The walls 16 and 18 are of substantially the same size and shape with their dimensions such that when folded together with an interposed blade properly positioned therein, either blade edge is exposed through the longitudinal slit which the two walls then establish.

As the interposed blade must be held in place, the first wall 16 is shown as having bosses 20, one adjacent its web end and the other in a central location. The other end of the first wall has an opening 21. The bosses and the opening 21 are so located that, with the second wall spaced from the first wall to expose the full length thereof, a blade 10 may be placed thereon with either edge exposed with the bosses 20 extending through the central blade slot 12 and the end recess 13 adjacent the web 19 and is thus held substantially in place until the walls are folded together. The second wall is provided with recesses 22 then to receive the ends of the bosses 20.

In order that the two walls will not be spaced apart by the channel 11 of the blade 10 when its cutting edge is exposed, both walls have shallow recesses 23 which together accommodate the blade channel 11 and enable the two walls to be in intimate contact with the interposed blade.

In order that the two walls may be locked together, the second wall is provided at its free end with a latch 24 dimensioned and disposed to pass through the end opening 21 at the corresponding end of the wall 16 and to be caught by the margin thereof, the wall 18 being sufficiently flexible to permit the latch to be easily engaged or disengaged. For example and as a preferred manner of operation, the tool is placed on a flat surface 25 with the wall 16 and the exposed end of the latch 24 in contact therewith and digital pressure is then applied to the portion 14 close to the shoulder 17 and preferably near the end of the wall 18 provided with the latch 24. The wall 18 then springs into a partly open position enabling it to be moved into a position in which a blade 10 may be safely placed on the wall 16 in the manner previously described.

The shoulder 17 is shown as having two short projections 26 overlying the wall 16 and spaced therefrom to establish holders in which the blade channel 11 fits. When the tool is used with the latch 24 disposed towards a surface being scraped, pressure exerted by the blade 10 on the second wall is limited by the projections 26 from being flexed. The second wall 18 has recesses 27, one for each projection 26, shaped and dimensioned to enable the second wall 18 and the projection 26 to be in the same plane when a blade 10 is being held with either edge exposed.

From the foregoing, it will be apparent that production costs are minimized by the use of a one piece injection molding and that the use of the tool in the described manner ensures maximum convenience and safety.

We claim:

1. A molded, one piece cutting and scraping tool for use with a blade such as a razor blade having parallel edges and at least one opening to receive a blade positioning boss of a razor, said tool including a first portion shaped and dimensioned to be held by one hand of the user and a blade holding end portion provided with first and second walls, the first wall of less thickness than the adjacent end of the first portion and defining therewith a transverse shoulder, the first wall shaped and dimensioned to provide a seat on which the blade is to be positioned with side margins of the first wall exposed and with the seat having a boss positioned to enter the blade opening, said first wall also having a lengthwise margin so spaced from the shoulder that an edge of the blade when positioned on the seat will protrude therefrom and said first wall including an aligned, lateral extension provided with an end section which is shaped and dimensioned to constitute the second wall and a flexible web between the two walls enabling the second wall to be folded over and against the first wall or a blade positioned on the seat, the free end of the second wall and the corresponding end of the first wall having interengagable latch portions which releaseably connect the walls when pressed together.

2. The tool of claim 1 in which the shoulder at the junction is provided with at least one projection overlying the first wall and defining therewith a receiver for the other edge of the blade, and the second wall has an opening shaped and dimensioned to accommodate the projection when the two walls are connected, the outer surface of the second wall and the projection then in the same plane.

3. The tool of claim 1 in which the blade is a single edge blade having a central aperture and openings at each end located along a center line parallel to the blade edges and intersecting the central aperture, there are two bosses on one wall so spaced and positioned that one boss may enter the central aperture and one boss may enter the recess adjacent the hingedly interconnected ends of the walls and the releasable means includes a portion passing through the other end opening when said means interconnects said other ends of the walls.

4. The tool of claim 3 in which the bosses are on the first wall and the releasable means includes a latch on the second wall which passes through the opening in the first wall and catches on the margin said opening to interconnect the walls, and the latch includes a section which then serves as a positioning boss in the other end of the blade.

5. The tool of claim 4 in which the latch protrudes through the first wall opening to an extent such that with the tool positioned on a flat surface, first wall dispose downwardly, the end portion of the body is held from the surface and the second wall is sufficiently flexible so that downward digital pressure applied to the body adjacent the shoulder effects latch disengagement.

* * * * *